US009458412B2

(12) United States Patent
Schymitzek et al.

(10) Patent No.: US 9,458,412 B2
(45) Date of Patent: Oct. 4, 2016

(54) FABRIC SOFTENER COMPOSITION WITH TRIALKANOLAMINE-BASED ESTER QUAT

(71) Applicant: Henkel AG & Co. KGaA, Duesseldorf (DE)

(72) Inventors: Tatiana Schymitzek, Krefeld (DE); Carine Wattebled, Duesseldorf (DE); Dietmar Schroter, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 14/682,711

(22) Filed: Apr. 9, 2015

(65) Prior Publication Data

US 2015/0210959 A1 Jul. 30, 2015

Related U.S. Application Data

(63) Continuation of application No. PCT/EP2013/071455, filed on Oct. 15, 2013.

(30) Foreign Application Priority Data

Oct. 19, 2012 (DE) ..... 10 2012 219 124

(51) Int. Cl.

| | |
|---|---|
| ***C11D 1/835*** | (2006.01) |
| ***C11D 3/00*** | (2006.01) |
| ***C11D 1/62*** | (2006.01) |
| ***C11D 3/30*** | (2006.01) |

(52) U.S. Cl.

CPC ..... *C11D 3/0015* (2013.01); *C11D 1/62* (2013.01); *C11D 3/30* (2013.01)

(58) Field of Classification Search

CPC ..... C11D 1/835; C11D 3/0015

See application file for complete search history.

(56) References Cited

U.S. PATENT DOCUMENTS

| | | | | |
|---|---|---|---|---|
| 4,923,642 | A | 5/1990 | Rutzen et al. | |
| 6,083,899 | A | 7/2000 | Baker et al. | |
| 2004/0097395 | A1* | 5/2004 | Crutzen | C11D 1/62 510/515 |
| 2005/0022312 | A1 | 2/2005 | Bigorra Llosas et al. | |
| 2009/0093394 | A1* | 4/2009 | Bernhardt | C11D 3/001 510/515 |
| 2010/0331231 | A1* | 12/2010 | Bermejo Oses | C07C 219/06 510/521 |

FOREIGN PATENT DOCUMENTS

| | | | |
|---|---|---|---|
| DE | 4338998 | A1 | 5/1995 |
| WO | 2004/050812 | A1 | 6/2004 |

OTHER PUBLICATIONS

PCT International Search Report (PCT/EP2013/071455) dated Jan. 14, 2014.

* cited by examiner

*Primary Examiner* — John Hardee
(74) *Attorney, Agent, or Firm* — Thomas G. Krivulka

(57) ABSTRACT

The application describes a liquid fabric softener composition which contains a softening mixture of trialkanolamine-based ester quat and trialkanolamine-based ester and which is free from methanol.

8 Claims, No Drawings

FABRIC SOFTENER COMPOSITION WITH TRIALKANOLAMINE-BASED ESTER QUAT

FIELD OF THE INVENTION

The present invention generally relates to a liquid fabric softener composition with trialkanolamine-based ester quat.

BACKGROUND OF THE INVENTION

Softeners are added to the laundry in the last rinse cycle of the machine wash to suppress the "dry stiffness" effect that occurs in drying laundry. Dry stiffness originates in the formation of hydrogen bridge bonds between the cellulose fibers. The cationic, softening compounds of the softener penetrate into the fibers or lie on the surface of the fibers, combine with the negative charges and thus weaken the interactions. The reduced stiffness of the laundry item reduces the effort involved in ironing and increases wear comfort.

Liquid softeners are divided into two types: "regular" softeners containing 1 to 5 wt. % of softening compounds and "concentrated" softeners containing 5 to 80 wt. % of softening compounds.

The acceptance of a softener product by users is determined not only by the actual performance but also to a great extent by the viscosity of the product, with medium to high viscosities being preferred by users. Desired viscosities are in the range from 10 to 400 mPas for regular softeners and in the range from 100 to 600 mPas for concentrated softeners (determined in each case with an RV DV II+P Brookfield viscometer; spindle 2 at 20 rpm and 20° C.).

In regular softeners in particular the viscosity after production is often too low, and thickeners are added to the products to increase the viscosity. For example, the use of homopolymers and/or copolymers as thickeners in softeners is known from WO 2004/050812 A1.

The thickeners that are used often have no softening capacity themselves and they increase the manufacturing costs for the softeners. Furthermore, not all thickeners are compatible with the ingredients used in the softeners.

A problem addressed by this invention was therefore to provide a liquid fabric softener composition having a sufficiently high viscosity and containing little or no thickener.

Surprisingly this problem was solved by means of a liquid fabric softener composition containing 0.5 to 40 wt. %, relative to the total fabric softener composition, of a softening mixture of trialkanolamine-based ester quat and trialkanolamine-based ester, the liquid fabric softener composition being free from methanol.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A liquid fabric softener composition, containing 0.5 to 40 wt. %, relative to the total fabric softener composition, of a softening mixture of trialkanol-amine based ester quat and trialkanolamine-based ester, the liquid fabric softener composition being free from methanol.

Use of a methanol-free, softening mixture of trialkanolamine-based ester quat and trialkanolamine-based ester to increase the viscosity of a liquid fabric softener composition.

Use of a methanol-free, softening mixture of trialkanolamine-based ester quat and trialkanolamine-based ester in a liquid fabric softener composition to increase the softness of textile fabrics treated with the liquid fabric softener composition.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Surprisingly it has been found that liquid fabric softener compositions which contain a mixture of a trialkanolamine-based ester quat and a trialkanolamine-based ester and which moreover are free from methanol have higher viscosities than liquid fabric softener compositions containing no trialkanol-based ester and small amounts (≥50 ppm) of methanol. In addition, textiles treated with such a liquid fabric softener composition have an increased/improved softness.

A particularly strong rise in viscosity can be obtained in liquid fabric softener compositions in which the amount of fabric softening mixture is 3 to 18 wt. %, relative to the total liquid fabric softener composition.

The invention also relates to the use of a methanol-free, softening mixture of trialkanolamine-based ester quat and trialkanolamine-based ester to increase the viscosity of a liquid fabric softener composition.

The invention likewise relates to the use of a methanol-free, softening mixture of trialkanolamine-based ester quat and trialkanolamine-based ester in a liquid fabric softener composition to increase the softness of textile fabrics treated with the liquid fabric softener composition.

Liquid fabric softener compositions according to the invention are described in detail below, inter alia by reference to examples.

Liquid fabric softener compositions according to the invention contain a softening mixture comprising as mandatory constituents a trialkanolamine-based ester quat and a trialkanolamine-based ester.

The term "trialkanolamine-based ester quats" is understood to mean quaternized fatty acid trialkanolamine ester salts. Trialkanolamine-based ester quats are usually produced in two stages: 1) esterification of trialkanolamine with fatty acids to form the trialkanolamine-based ester and 2) quaternization of the esters obtained with dimethylsulfate or chloromethane.

RCOOH fatty acids, in which RCO denotes an aliphatic, saturated and/or unsaturated acyl residue having 6 to 22 carbon atoms, are used to produce the ester quats. Typical examples are hexanoic acid, octanoic acid, 2-ethylhexanoic acid, decanoic acid, lauric acid, isotridecanoic acid, myristic acid, palmitic acid, palmitoleic acid, stearic acid, isostearic acid, oleic acid, elaidic acid, petroselic acid, linoleic acid, linolenic acid, elaeostearic acid, eicosanoic acid, gadoleic acid, docosanoic acid and erucic acid and technical mixtures thereof. Fatty acids having 12 to 18 carbon atoms, such as for example partially hydrogenated palm and/or tallow fatty acids, are preferably used which have an iodine value in the range from 0.5 to 50. In particular, tallow fatty acid is preferably used as the fatty acid.

Esterification takes place in the presence of hypophosphorous acid or salts thereof and optionally reducing agents such as sodium borohydride. Trialkanolamine and the fatty acids are used in the molar ratio 1:1.1 to 1:2.4, the ratio preferably being in the range from 1:1.4 to 1:1.9. The reaction is performed at temperatures in the range from 120 to 180° C.

Suitable trialkanolamines comprise for example triethanolamine, diethanol propanolamine and tripropanolamine, triethanolamine being preferred. Correspondingly it is preferable in particular for the trialkanolamine-based ester to be a triethanolamine-based ester.

The trialkanolamine-based ester is alkylated by preparing the ester and stirring it with the alkylating agent at elevated temperature (40 to 95° C.). The reaction can be performed in alcoholic solution, for example in isopropyl alcohol or ethanol. The alkylation is preferably performed with dimethyl sulfate. In particular, a trialkanolamine-based ester quat which is preferably obtained by alkylation is a triethanolamine-based ester quat.

It has been found that trialkanolamine-based ester quats in which the quaternizing agent is used in an equimolar amount or in a slight deficit relative to the trialkanolamine-based ester can contain an elevated amount of methanol in the raw material. Methanol can be detected in the raw material and in finished formulations, in particular softeners. The methanol content in the raw material can be 0.1 to 3 wt. %. Finished formulations contain 50 to 300 ppm of methanol, depending on the amount of raw material used.

Surprisingly it has been found that if the quaternizing agent is used in a clear deficit relative to the trialkanolamine-based ester, namely in a maximum ratio of 0.8, a mixture of trialkanolamine-based ester quat and trialkanolamine-based ester is obtained which is free from methanol and which when used in liquid fabric softener compositions also leads to a higher viscosity and a greater softness. Therefore it is particularly preferable for the ratio of trialkanolamine-based ester quat to trialkanolamine-based ester in the softening mixture obtained after alkylation to be between 2:1 and 4:1. This process control has the advantage that the mixture obtained can be used directly in the liquid fabric softener composition with no further processing and that methanol formed during alkylation does not have to be removed subsequently.

It is preferable in particular for the trialkanolamine-based ester quat to be a compound of the following formula:

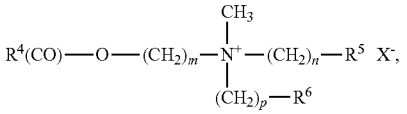

in which $R^4$ denotes an aliphatic alk(en)yl residue having 6 to 22 carbon atoms with 0, 1, 2 or 3 double bonds and/or optionally with substituents; $R^5$ denotes OH or $O(CO)R^7$, $R^6$ independently of $R^5$ denotes OH or $O(CO)R^8$, wherein $R^7$ and $R^8$ independently of one another each denote an aliphatic alk(en)yl residue having 11 to 21 carbon atoms with 0, 1, 2 or 3 double bonds, m, n and p can independently of one another each have the value 1, 2 or 3 and $X^-$ can be either a halide, methosulfate, methophosphate or phosphate ion or mixtures of these anions. $R^4$, $R^7$ and $R^8$ are preferably derived from tallow fatty acid and $X^-$ is a methosulfate ion.

If the trialkanolamine-based esters and trialkanolamine-based ester quats have unsaturated alkyl chains, acyl groups are preferred whose corresponding fatty acids have an iodine value of between 1 and 100, preferably between 5 and 80, more preferably between 10 and 60 and in particular between 15 and 45 and which have a cis/trans isomer ratio (in wt. %) of greater than 30:70, preferably greater than 50:50 and in particular greater than or equal to 60:40.

Trialkanolamine-based esters which can preferably be used are N-(2-hydroxyethyl)-N,N-di(tallow acyloxyethyl) amine, N-(2-hydroxyethyl)-N,N-di(palmacyloxyethyl) amine or N-(2-hydroxyethyl)-N,N-di(stearoyloxyethyl) amine.

Trialkanolamine-based ester quats which can preferably be used are correspondingly methyl-N-(2-hydroxyethyl)-N,N-di(tallow acyloxyethyl)ammonium methosulfate, methyl-N-(2-hydroxyethyl)-N,N-di(palmacyloxyethyl)ammonium methosulfate or methyl-N-(2-hydroxyethyl)-N,N-di(stearoyloxyethyl)ammonium methosulfate.

It is moreover preferable for the trialkanolamine-based ester quat to be a mixture of monoester compound, diester compound and triester compound. A mixture of monoester, diester and triester compounds has the best property in terms of softness performance and trapping of anionic residues such as anionic surfactants for example, which undesirably remain in the washing machine drum as a result of the washing process.

The liquid fabric softener composition contains the softening mixture of trialkanolamine-based ester quat and trialkanolamine-based ester in an amount from 0.5 to 40 wt %, more preferably in an amount from 1 to 30 wt. % and still more preferably in an amount from 2 to 25 wt. %, relative in each case to the total liquid fabric softener composition. The amount of softening mixture is most particularly preferably 3 to 18 wt. %, relative to the total liquid fabric softener composition.

Correspondingly, particularly preferred liquid fabric softener compositions contain 2.4 to 14.4 wt. % of trialkanolamine-based ester quat and 0.6 to 3.6 wt. % of trialkanolamine-based ester, relative to the total liquid fabric softener composition.

It is preferable for the liquid fabric softener composition to have a pH of less than 4, preferably less than 3. Depending on the pH of the liquid fabric softener composition, at least some of the trialkanolamine-based ester is in protonated form. The best softening performance is obtained with a softening mixture in which the trialkanolamine-based ester is present in the liquid fabric softener composition entirely in protonated form. It is preferable for the liquid fabric softener composition to be a softener with a pH of less than 3.

In addition to the trialkanolamine-based ester quat and the trialkanolamine-based ester, the liquid fabric softener compositions can contain further ingredients which further improve the application-related and/or aesthetic properties of the liquid fabric softener composition. In the context of the present invention preferred fabric softener compositions additionally contain one or more substances from the group of further fabric softening compounds, enzymes, electrolytes, non-aqueous solvents, pH adjusters, perfumes, perfume carriers, perfume microcapsules, fluorescent agents, dyes, soil release polymers, optical brighteners, graying inhibitors, anti-shrink agents, anti-crease agents, dye transfer inhibitors, antimicrobial active agents, germicides, fungicides, antioxidants, preservatives, corrosion inhibitors, antistatics, bittering agents, ironing aids, phobing and impregnating agents and UV absorbers. The softeners of the present invention particularly preferably contain further fabric softening compounds, electrolytes, non-aqueous solvents, preservatives, pH adjusters, perfume, perfume microcapsules and/or dyes as further ingredients. The liquid fabric softener compositions contain water as the main solvent.

A preferred further ingredient is a further fabric softening compound which is a polysiloxane in particular. The use of polysiloxanes as a further fabric softening compound is advantageous because they not only have a softening effect but also intensify the perfume impression of the laundry. A polysiloxane which can preferably be used has at least the following structural unit:

a)

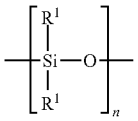

where $R^1$=independently of one another $C_1$-$C_{30}$ alkyl, preferably $C_1$-$C_4$ alkyl, in particular methyl or ethyl, n=1 to 5000, preferably 10 to 2500, in particular 100 to 1500.

It can be preferable for the polysiloxane additionally also to have the following structural unit:

b)

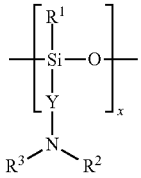

where $R^1$=$C_1$-$C_{30}$ alkyl, preferably $C_1$-$C_4$ alkyl, in particular methyl or ethyl, Y=optionally substituted, linear or branched $C_1$-$C_{20}$ alkylene, preferably —$(CH_2)_m$— with m=1 to 16, preferably 1 to 8, in particular 2 to 4, especially 3, $R^2$, $R^3$=independently of one another H or optionally substituted, linear or branched $C_1$-$C_{30}$ alkyl, preferably amino-group-substituted $C_1$-$C_{30}$ alkyl, particularly preferably —$(CH_2)_b$—$NH_2$ with b=1 to 10, extremely preferably b=2, x=1 to 5000, preferably 10 to 2500, in particular 100 to 1500.

If the polysiloxane has only structural unit a) with $R^1$=methyl, it is a polydimethylsiloxane. Polydimethylpolysiloxanes are known to be efficient fabric care compounds.

Suitable polydimethylsiloxanes include DC-200 (from Dow Corning), Baysilone® M 50, Baysilone® M 100, Baysilone® M 350, Baysilone® M 500, Baysilone® M 1000, Baysilone® M 1500, Baysilone® M 2000 or Baysilone® M 5000 (all from GE Bayer Silicones).

However, it can also be preferable for the polysiloxane to contain structural units a) and b). A particularly preferred polysiloxane has the following structure:

$$(CH_3)_3Si—[O—Si(CH_3)_2]_n—[O—Si(CH_3)\{(CH_2)_3—NH—(CH_2)_2—NH_2\}]_x—OSi(CH_3)_3$$

where the sum n+x is a number between 2 and 10,000.

Suitable polysiloxanes having structural units a) and b) are commercially available for example under the brand names DC2-8663, DC2-8035, DC2-8203, DC05-7022 or DC2-8566 (all from Dow Corning). The commercially available products Dow Corning® 7224, Dow Corning® 929 Cationic Emulsion or Formasil 410 (GE Silicones), for example, are likewise suitable.

In the case of liquid fabric softener compositions according to the invention containing perfume microcapsules, a longer-lasting perfume impression could be observed in the laundry in comparison to methanol-containing liquid fabric softener compositions containing perfume microcapsules.

The liquid fabric softener compositions can be used for conditioning textile fabrics.

The liquid fabric softener compositions are produced by softener production methods that are familiar to the person skilled in the art. It can be done for example by mixing the raw materials, optionally using high-shear mixing apparatus, for example. Melting the trialkanolamine-based ester quat and the trialkanolamine-based ester and then dispersing the melt in a solvent, preferably water, is recommended. The further ingredients can be integrated by simply mixing them into the liquid fabric softener compositions.

Table 1 shows four fabric softener compositions according to the invention, E1 to E4 and four fabric softener compositions not according to the invention, C1 to C4 (amounts in wt. % of active substance).

TABLE 1

| | E1 | E2 | E3 | E4 | C1 | C2 | C3 | C4 |
|---|---|---|---|---|---|---|---|---|
| Ester quat* | 5.76 | 5.76 | 5.76 | 7.28 | 7.2 | 7.2 | 7.2 | 9.08 |
| Ester** | 1.44 | 1.44 | 1.44 | 1.8 | — | — | — | — |
| 2-Propanol | 0.8 | 0.8 | 0.8 | — | 0.8 | 0.8 | 0.8 | — |
| Ethanol | — | — | — | 1 | — | — | — | 1 |
| Polysiloxane*** | 0.25 | 0.25 | 0.25 | 0.25 | 0.25 | 0.25 | 0.25 | 0.25 |
| pH adjuster | 0.05 | 0.05 | 0.05 | 0.05 | 0.05 | 0.05 | 0.05 | 0.05 |
| $MgCl_2$ | 0.1 | 0.1 | 0.1 | 0.1 | 0.1 | 0.1 | 0.1 | 0.1 |
| Glycerol | — | — | 18 | — | — | — | 18 | — |
| Dye | + | + | + | + | + | + | + | + |
| Free perfume**** | 0.8 | 0.9 | 0.43 | 0.8 | 0.8 | 0.9 | 0.43 | 0.8 |
| Perfume microcapsules | 0.3 | 0.3 | — | — | 0.3 | 0.3 | — | — |
| Methanol***** | 0 | 0 | 0 | 0 | + | + | + | + |
| Water | to 100 | to 100 | to 100 | to 100 | to 100 | to 100 | to 100 | to 100 |
| Viscosity [mPas]# | 170 | 110 | 110 | 80 | 125 | 75 | 45 | 60 |

*N-methyl-N-(2-hydroxyethyl)-N,N-(ditallow acyloxyethyl)ammonium methosulfate

**N-(2-hydroxyethyl)-N,N-di(tallow acyloxyethyl)amine

***Formasil 410 from GE Silicones

****as the perfume also has an influence on viscosity, an identical perfume was used in all the softeners

*****the amount of methanol in the fabric softener compositions not according to the invention, C1 to C4, was >50 ppm

#the viscosity of the liquid fabric softener compositions was determined using a Brookfield RV DV II + P viscometer; spindle 2 at 20 rpm and 20° C.

The results clearly show that the methanol-free, liquid fabric softener compositions have higher initial viscosity values than the fabric softener compositions with methanol.

Compositions E1 to E4 were stable in storage for several weeks, showing no undesired changes and only slight viscosity changes or fluctuations during storage. To determine the storage stability the compositions were stored in electronically controlled heated chambers under differing climatic conditions. The storage period was 4 weeks. After 2 and 4 weeks a visual and olfactory sampling of the fabric softener compositions was performed and the viscosity was determined.

To compare the scent intensity of the methanol-free liquid fabric softener composition E4 with the methanol-containing liquid fabric softener composition C4, toweling fabric was treated in a washing machine (Miele Novotronic W 985) first with a solid washing agent in the main wash cycle and then in the rinse cycle with 26 ml in each case of the fabric softener composition to be tested. After being hung up to dry the softness of the fabric was determined:

| Composition | Softness value |
|---|---|
| E4 | 4 |
| C4 | 3.4 |

Rating: 0 = hard to 7 = soft
Number of assessors: 7

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A liquid fabric softener composition, comprising 0.5 to 40 wt. %, relative to the total fabric softener composition, of a softening mixture of trialkanol-amine based ester quat and trialkanolamine-based ester, wherein the ratio of trialkanolamine-based ester quat to trialkanolamine-based ester is between 2:1 and 4:1, and wherein the liquid fabric softener composition is free from methanol.

2. The liquid fabric softener composition according to claim 1, wherein the amount of softening mixture is 3 to 16 wt. %, relative to the total fabric softener composition.

3. The liquid fabric softener composition according to claim 1, wherein the trialkanolamine-based ester quat comprises a mixture of monoester compound, diester compound and triester compound.

4. The liquid fabric softener composition according to claim 1, wherein at least part of the trialkanolamine-based ester is protonated.

5. The liquid fabric softener composition according to claim 1, wherein the trialkanolamine-based ester is entirely protonated.

6. The liquid fabric softener composition according to claim 1, wherein the trialkanolamine-based ester quat is a triethanolamine-based ester quat.

7. The liquid fabric softener composition according to claim 1, wherein the trialkanolamine-based ester is a triethanolamine-based ester.

8. The liquid fabric softener composition according to claim 1, characterized in that the liquid fabric softener composition has a pH of less than 4.

* * * * *